US006358367B1

(12) United States Patent
Doelle et al.

(10) Patent No.: US 6,358,367 B1
(45) Date of Patent: Mar. 19, 2002

(54) PULPING SYSTEM FOR A PAPER MACHINE

(75) Inventors: Klaus Doelle; Werner Witek; Robert J. Matz, all of Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/494,948

(22) Filed: Feb. 1, 2000

(51) Int. Cl.[7] ..... B26F 1/26; B26F 1/31

(52) U.S. Cl. ..... 162/194; 162/193; 162/189; 162/191; 162/198; 162/203; 241/1; 241/21; 241/22; 241/24.19; 241/38; 83/24; 83/53; 219/121.72

(58) Field of Search ..... 162/189, 191, 162/193–195, 198, 201, 264, 275–296, 289, 286; 241/1, 21–22, 24.19, 24.2, 29, 38, 46.9; 83/24, 53, 98, 177, 402, 428; 219/121.67, 121.72

(56) References Cited

U.S. PATENT DOCUMENTS 1,637,240 A * 7/1927 Proctor ..... 162/193
1,789,515 A * 1/1931 Cram et al. ..... 162/193
2,860,550 A * 11/1958 Stark ..... 162/261
2,954,082 A * 9/1960 Moore ..... 162/264
3,011,733 A * 12/1961 Ford ..... 162/255
3,236,723 A * 2/1966 Whiteside ..... 162/264
3,625,813 A * 12/1971 Eckelman ..... 162/286
3,660,226 A * 5/1972 McKeown ..... 162/264
3,669,830 A * 6/1972 Williams ..... 162/264
3,770,579 A * 11/1973 Cline ..... 162/264
4,182,170 A * 1/1980 Grupp ..... 83/177
4,209,362 A * 6/1980 Salmela et al. ..... 162/264
4,818,343 A * 4/1989 Laine ..... 162/286
5,185,063 A * 2/1993 Aula et al. ..... 162/193
5,582,686 A * 12/1996 Chupka et al. ..... 162/194
5,852,963 A * 12/1998 Koponen et al. ..... 83/53
6,073,824 A * 6/2000 Gray et al. ..... 225/2

* cited by examiner

*Primary Examiner*—Jose Fortuna
(74) *Attorney, Agent, or Firm*—Taylor & Aust, P.C.

(57) ABSTRACT

A paper machine includes a traveling belt for carrying a fiber web, and a cutting device disposed below the belt for cutting the fiber web into smaller pieces. The cutting device has an inlet and an outlet. A guiding device guides the fiber web from the belt to the inlet of the cutting device. A pulper is connected with the outlet of the cutting device for receiving the smaller pieces of fiber web from the cutting device. The traveling belt may be in the form of, e.g., a wire, felt or water impervious belt. The cutting device may be in the form of, e.g., a shredder, fluffer, water jet cutter, laser cutter and/or roll cutter.

7 Claims, 3 Drawing Sheets

PULPING SYSTEM FOR A PAPER MACHINE

BACKGROUND OF THE INVENTION

1. Field of the Invention

The present invention relates to paper machines, and, more particularly, to a broke handling system for handling a fiber web produced by a paper-making machine during a sheet break.

2. Description of the Related Art

A paper-making machine receives a prepared fiber suspension and produces a fiber web, such as a paper web. The paper-making machine includes a plurality of sequentially arranged traveling surfaces such as a wire, felt or water impervious belt (generically referred to herein as a belt) which carry the fiber web from one end of the machine to the other end.

Although not desirable, the traveling fiber web will occasionally break during operation of the paper-making machine (known as a "sheet break"). Sensors may be utilized within the paper-making machine to detect a sheet break. When a sheet break occurs, the fiber web is directed to an area below the paper-making machine where it is manually collected by workers and either discarded or returned to a pulping system for reuse. For example, the fiber web may be directed to an area below the paper-making machine through a space where the fiber web is typically transferred from one belt to another. Since a fiber web may be approximately 10 meters wide and can travel at speeds up to approximately 6,000 feet per minute, the amount of fiber web which is discarded in an area below the paper-making machine can be substantial before the machine is stopped or the fiber web is reestablished in the paper machine. A sheet break therefore not only is undesirable in terms of reduced throughput rate, but also requires unnecessary labor on the part of attending workers.

What is needed in the art is a system for effectively and efficiently handling and/or repulping a fiber web upon occurrence of a sheet break in a paper-making machine.

SUMMARY OF THE INVENTION

The present invention provides a paper machine with an under-machine handling system having a cutting device which cuts a fiber web into a plurality of smaller pieces upon occurrence of a sheet break. The smaller pieces can be easily transported to a number of broke fiber recovery devices or systems for reuse in the paper machine.

The invention comprises, in one form thereof, a paper machine having a traveling belt for carrying a fiber web. A cutting device is disposed below the belt for cutting the fiber web into smaller pieces. The cutting device has an inlet and an outlet. A guiding device guides the fiber web from the belt to the inlet of the cutting device. A pulper is connected with the outlet of the cutting device for receiving the smaller pieces of fiber web from the cutting device. The traveling belt may be in the form of, e.g., a wire, felt or water impervious belt. The cutting device may be in the form of, e.g., a shredder, fluffer, water jet cutter, laser cutter and/or roll cutter.

An advantage of the present invention is that the fiber web is cut into a plurality of smaller pieces before being fed into a broke fiber recovery device, thereby providing a more effective and flexible system. For example, for a pulper used as a broke recovery device the inlet to the pulper occupies less space, and thus the overall size of the pulper may be reduced.

Yet another advantage is that cutting the fiber web into smaller pieces allows less energy to be used by the pulper during the repulping process.

A still further advantage is that the cut smaller pieces can be transported directly into a high consistency pulper and/or high consistency pump, thereby reducing the amount of water used during the pulping process.

A still further advantage is that the cut smaller pieces can be introduced directly into a blower tank or baler for subsequent transfer to a pulper, thereby further reducing the amount of water consumed during the pulping process.

Another advantage is that by cutting the fiber web into smaller pieces, the size of the pulping system can be reduced, thereby resulting in less physical space requirements and capital investment costs.

A still further advantage is that since the pulping system is smaller in size as a result of the cut smaller pieces, the amount of space occupied by the pulping system under the paper-making machine is less which results in more space for other equipment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
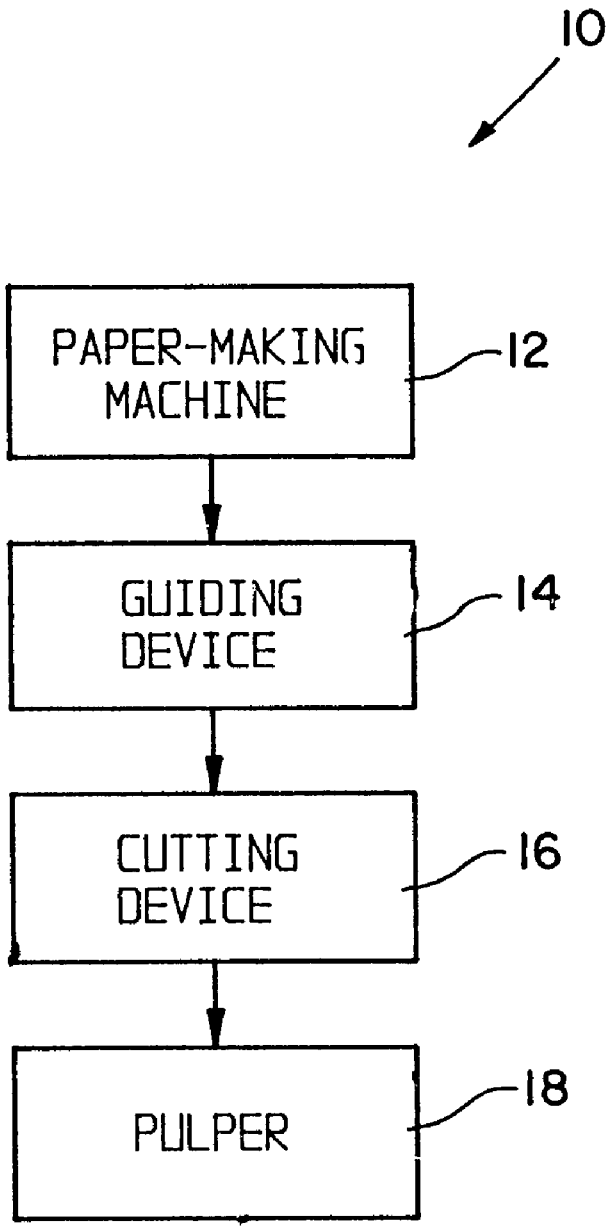
FIG. 1 is a block diagram of an embodiment of a paper machine of the present invention.

Referring now to the drawings, and more particularly to FIG. 1, there is shown an embodiment of a paper machine 10 of the present invention, which generally includes a paper making machine 12, guiding device 14, cutting device 16 and pulper 18. Guiding device 14, cutting device 16, pulper 18 define a broke handling system for handling a broke fiber web. The term "pulper" is intended to cover either a pulper or repulper. Paper-making machine 12 includes a plurality of belts which are sequentially arranged along the length of the machine for carrying a fiber web from one end of the machine to another. The term "belt" is used in a generic sense herein to indicate a traveling surface within paper-making machine 12 for carrying the fiber web, such as a wire, felt, water impervious belt, roll, etc.

Guiding device 14 guides the fiber web upon occurrence of a sheet break into cutting device 16. Guiding device 14 may include a plurality of air blowers, water jets, guide belts, etc. for directing the fiber web toward cutting device 16.

Cutting device 16 receives the fiber web and cuts the fiber web into a plurality of smaller pieces, such as strips, chopped or ground pieces, etc. Cutting device 16 may be in the form of a shredder, fluffer, water jet cutter, laser cutter, roll cutter or other device for cutting the fiber web into smaller pieces.

Pulper 18 receives the cut smaller pieces and substantially separates the fibers into individual fibers which may be suspended within a slurry and recycled for use in paper-making machine 12.

Figure 2:
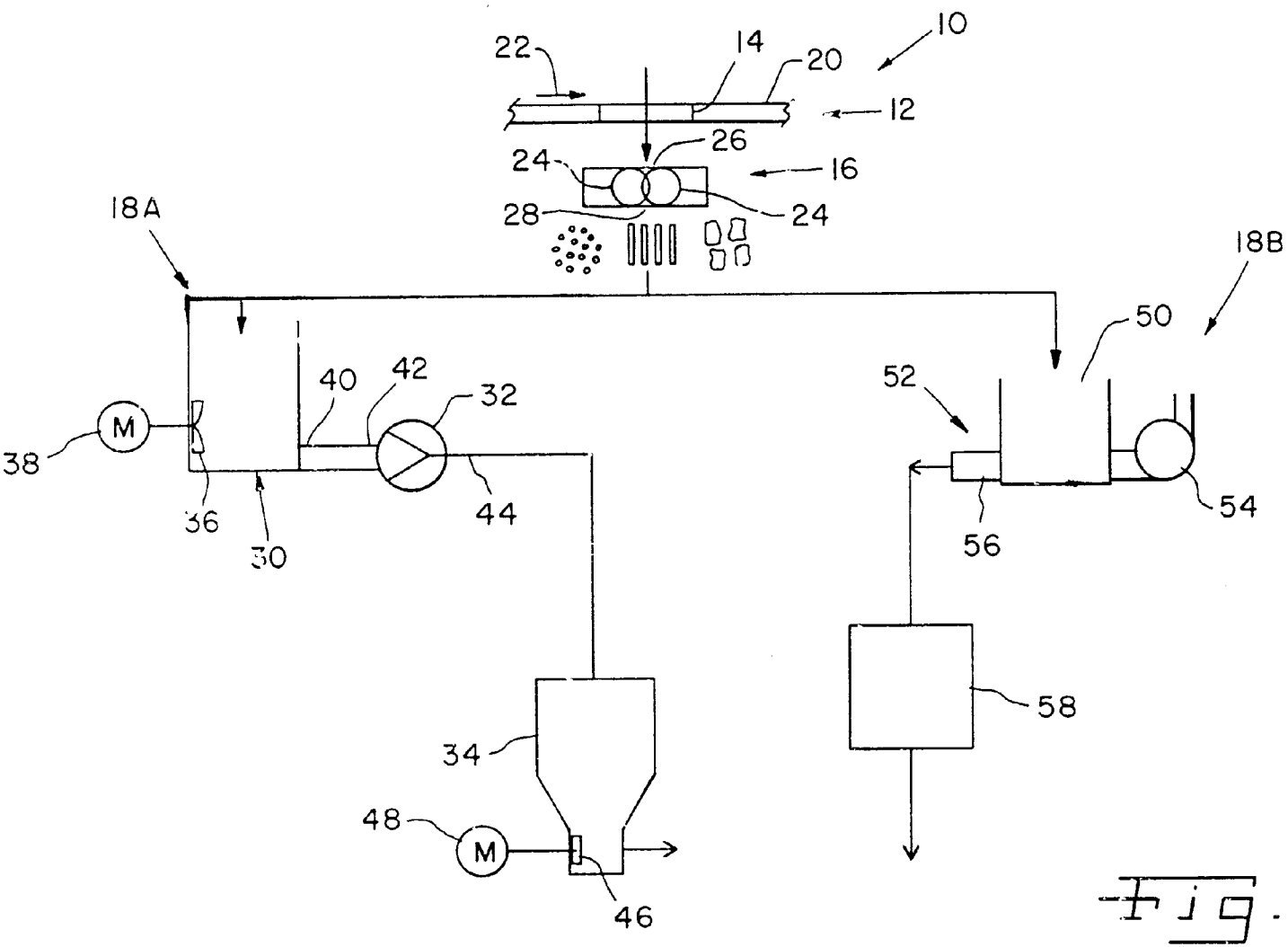
FIG. 2 is a schematic illustration showing in more detail different alternative embodiments of the paper machine of the present invention.

FIG. 2 is a schematic illustration showing different possible configurations of paper machine 10. Paper-making machine 12 includes a traveling belt 20 which moves in a particular direction to transport the fiber web from one end of paper-making machine 12 to an opposite end. In the embodiment shown, belt 20 is illustrated as moving from left to right, as indicated by arrow 22.

Upon occurrence of a sheet break, the fiber web carried by belt 20 is directed through guiding device 14 to an area underneath paper-making machine 12. Guiding device 14 is schematically shown as including an opening associated with belt 20 of paper-making machine 12. Guiding device 14 may include a plurality of air nozzles, water showers, etc. to direct the fiber web to an area below paper-making machine 12.

Cutting device 16 receives the fiber web which is directed through guiding device 14 upon occurrence of a sheet break and cuts the fiber web into a plurality of smaller pieces, such as strips, chopped pieces, plate-shaped pieces, etc. Cutting device 16 may be in the form of a shredder, fluffer, water jet cutter, laser cutter, roll cutter or other device for cutting the fiber web into strips, smaller pieces or smaller sheets. In the embodiment shown, cutting device 16 is a shredder or fluffer which includes two shredder or fluffer wheels 24. The fiber web travels through inlet 26, is cut into smaller pieces by shredder wheels 24, and exits through outlet 28.

The cut smaller pieces are transported from cutting device 16 to a pulping system 18*a* and/or 18*b* via a suitable transport device such as a chute, belt conveyor, screen conveyor, pneumatic conveyor, etc. Pulping system 18*a* includes a high consistency pulper 30, high consistency pump 32 and storage vessel 34. Pulper 30 may also be in the form of a low or medium consistency pulper, and includes a rotor 36 which is rotatably driven therein by a motor 38. Rotor 36 moves the cut smaller pieces over a screen plate or the like to pulp the fiber suspension by substantially separating the fibers therein. To provide the fiber suspension with a desired consistency (e.g., 5–15%), water may be introduced into pulper 30, cut or the smaller pieces may be mixed with water prior to being transported into pulper 30. The pulped fibers are transported through an outlet 40.

High consistency pump 32 includes an inlet 42 which receives the pulped high consistency suspension and pumps the suspension through an outlet 44 to storage vessel 34. Pump 32 may also be configured as a low or medium consistency pump. Storage vessel 34 is used to store the pulped fiber suspension for subsequent recycling and reuse by paper-making machine 12. In the embodiment shown, storage vessel 34 may be in the form of a storage tower or storage chest with an integral pulper or agitator therein. The pulper within storage vessel 34 includes a rotor 46 which is rotatably driven by a motor 48. The fiber suspension may be continuously or intermittently pulped using rotor 46.

Pulping system 18B includes a blower tank 52 having an inlet 50 which receives the cut smaller pieces from cutting device 16. A blower 54 blows the cut smaller pieces within blower tank 52 through an outlet 56 to a storage vessel 58 or direct to a baler. In the embodiment shown, storage vessel 58 is in the form of a storage chest with an integral pulper or agitator.

Figure 3:
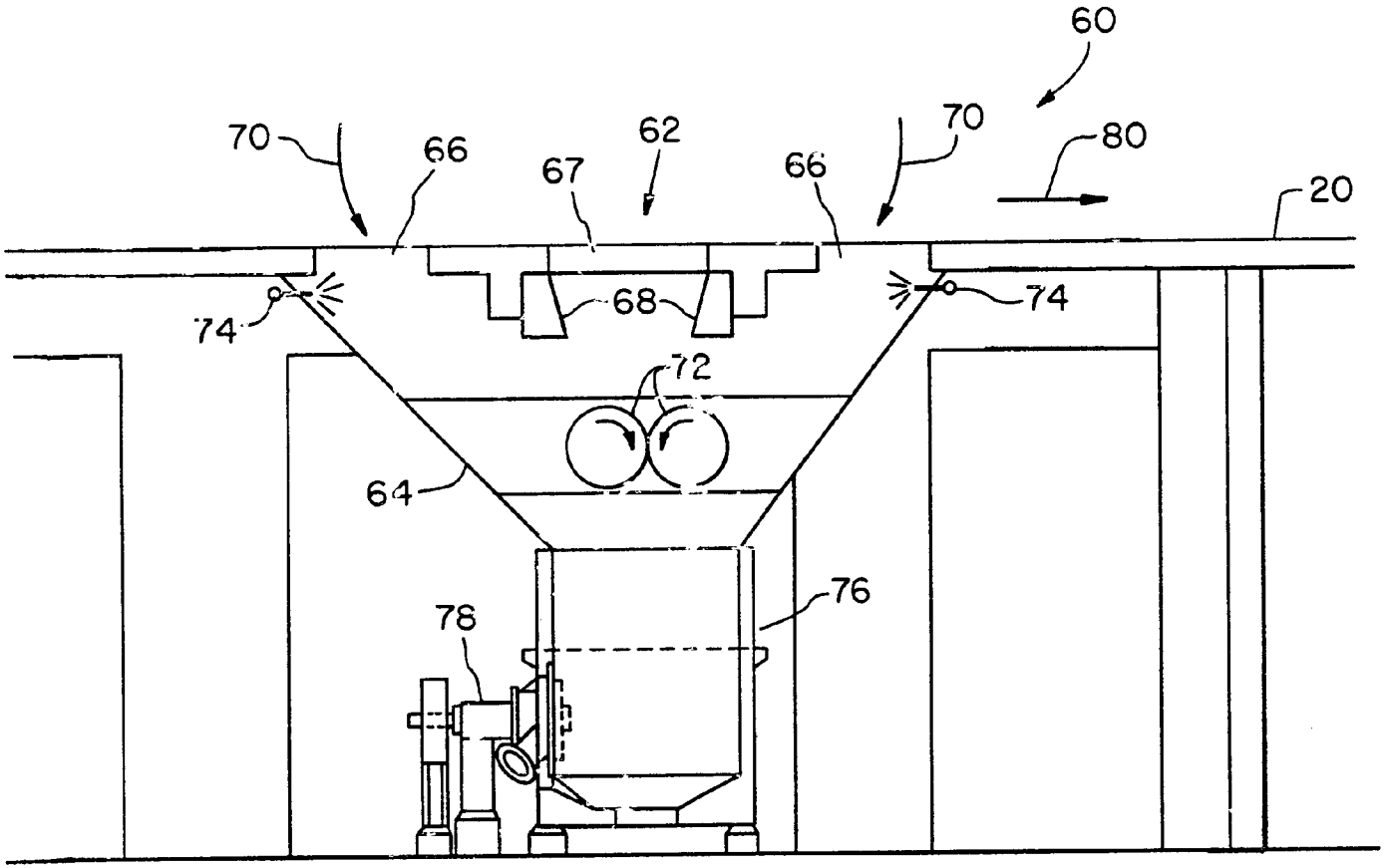
FIG. 3 is a side view of one of the embodiments of the paper machine shown in FIG. 2.

FIG. 3 is a side view of one possible configuration of a paper machine 60 using one of the different possible component configurations shown in FIG. 2. Paper machine 60 includes a guiding device 62 which guides the fiber web upon occurrence of a sheet break into cutting device 64. Guiding device 62 includes two openings 66 and a center opening 67 which are disposed in association with traveling belt 20. The fiber web may be transported into one or more openings 66 and/or 67, dependent upon the direction of travel of belt 20. To this end, guiding device 62 includes an air plenum 68 with air nozzles incorporated therein which guide the fiber web toward cutting device 64, as indicated by directional arrows 70. In the embodiment shown, belt 20 is assumed to move from left to right, as indicated by directional arrow 80. Thus, the fiber web likely is directed through the opening 66 shown on the left hand side of FIG. 3.

Cutting device 64 is in the form of a shredder with at least two shredding wheels 72 operated in a fixed or oscillating manner which shred the fiber web into smaller pieces. To assist in the shredding of the fiber web, one or more showers 74 may be provided within guiding device 62 for spraying water onto the fiber web which travels therethrough. The wet fiber web then travels toward shredding wheels 72 within cutting device 64 disposed below guiding device 62.

A pulper 76 is disposed below cutting device 64 and pulps the smaller pieces of fiber web to thereby substantially separate the individual fibers. More particularly, water may be added to the cut smaller pieces which are received from cutting device 64 at the inlet of pulper 76 disposed thereunder. A rotor (not shown) disposed within pulper 76 rotates the fiber suspension past suitable structure, such as a screen plate, to substantially separate the individual fibers therein. The rotor is driven by a motor 78. The pulped fiber suspension may be pumped to a storage vessel such as a storage chest 34 using a high consistency pump 32 (FIG. 2).

During use, belt 20 travels from one end of paper machine 60 to an opposite end, as indicated by arrow 80. Upon occurrence of a sheet break, the leading edge of the fiber web is directed into cutting device 64 through guiding device 62. More particularly, air plenum 68 includes a plurality of air nozzles or orifices which direct the fiber web through guiding device 62. As the fiber web travels through guiding device 62, one or more showers 74 spray water onto the fiber web to increase the moisture content thereof.

Shredder 64 receives the moistened fiber web and shreds the fiber web into a plurality of smaller pieces using shredder wheels 72. The cut smaller pieces then are transported into pulper 76 and mixed with additional water to form a fiber suspension. The fiber suspension is pulped to substantially separate the individual fibers. The pulped fiber suspension may then be stored within a storage vessel for recycling and reuse by paper-making machine 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of processing a fiber web in a paper machine, comprising the steps of:

carrying the fiber web on a traveling belt;

transporting the fiber web to a cutting device upon occurrence of a sheet break of the fiber web;

cutting the fiber web into smaller pieces using said cutting device;

providing a blower tank having an outlet and an inlet, said inlet receiving said smaller pieces of fiber web;

using a blower to blow said smaller pieces of fiber web from said outlet of said blower tank to a pulper; and pulping said smaller pieces of fiber web using said pulper.

2. The method of claim 1, wherein said transporting step comprises the substep of guiding said fiber web to said cutting device using a guiding device.

3. The method of claim 1, wherein said cutting device comprises one of a shredder, fluffer, water jet cutter, laser cutter and roll cutter.

4. The method of claim 3, wherein said cutting device comprises a shredder.

5. The method of claim 1, comprising the further step of positioning said cutting device below said belt.

6. The method of claim 1, wherein said cutting step comprises cutting the fiber web into at least one of strips, chopped pieces and plate-shaped pieces.

7. The method of claim 1, comprising the further step of connecting said blower tank outlet to said pulper.

* * * * *